United States Patent [19]

Pascher

[11] Patent Number: 5,069,153

[45] Date of Patent: Dec. 3, 1991

[54] HARNESS

[75] Inventor: Reinhard Pascher, Salzburg, Austria

[73] Assignee: Neil Pryde Limited, Hong Kong

[21] Appl. No.: 545,515

[22] Filed: Jun. 27, 1990

[30] Foreign Application Priority Data

Jun. 30, 1989 [GB] United Kingdom ..... 8915066

[51] Int. Cl.[5] ..... B63B 35/79

[52] U.S. Cl. ..... 114/39.2; 182/3

[58] Field of Search ..... 182/3, 4; 244/151 R; 119/96; 114/39.2; 24/536, 573.6, 588

[56] References Cited

U.S. PATENT DOCUMENTS 2,317,346 4/1943 Reith ..... 182/4

2,574,178 11/1951 Haller ..... 182/4 X 3,685,105 8/1972 Carlile et al. ..... 24/588 X 4,545,773 10/1985 Evert ..... 114/39.2 X

FOREIGN PATENT DOCUMENTS 2324506 4/1977 France ..... 114/39.2

*Primary Examiner*—Robert P. Swiatek

*Attorney, Agent, or Firm*—Willian Brinks Olds Hofer Gilson & Lione

[57] ABSTRACT

A harness for boardsailing has straps 42, 48 which are swivably mounted on substantially rigid panels 36, 38 by couplings 39, 47, 50. The couplings 39, 47, 50 each comprise two parts which snap fit together through an aperture in the panels 36, 38 and swivel in the apertures.

2 Claims, 4 Drawing Sheets

HARNESS

The present invention rélates to a harness, particularly for use in windsurfing or sailboarding, and to a coupling for attaching straps of the harness to a body panel.

It is known to use a harness for attaching to the body a boom hook which hooks over the boom of a sailboard, or over a rope attached to the boom. This enables the boardsailor to transfer his weight to the boom whilst relieving strain on the arms. Typically the harness is worn around the chest, the waist or the hips. Existing designs in which straps for attachment of the hook are sewn on to the harness can suffer from the drawback that the load on the hook is not transferred evenly about the harness, which makes the harness uncomfortable to wear. Also, in adjusting the position of the harness and during use the straps may twist and the stitching attaching the straps to the harness may be overloaded.

A first aspect of the invention provides a harness for boardsailing, the harness comprising a body part for fitting on the boardsailor and one or more straps, wherein a strap is swivably mounted on the body part.

By mounting a strap on the harness so that it can swivel or pivot about an axis generally perpendicular to the body part at the mounting point, the orientation of the strap relative to the harness can adjust without twisting the strap. This avoids associated increased loading on the attachment. The system is particularly advantageous for straps which are used to attach a boom hook to the harness in providing a more even distribution of load to the harness. The system can more easily respond to changes in the hook position and loading during sailing.

Other straps on the harness (fitting straps) may be used for securing the harness to the body and it is also advantageous to swivably mount these straps on the harness to accomodate different body sizes and body movement.

A coupling attaching a strap to the harness is preferably located in an aperture in the harness. More particularly, a circular aperture is provided in a substantially rigid panel forming part of the harness and the coupling has a peripheral groove, flanges forming the walls of the groove extending either side of the aperture so that the coupling is rotatably mounted on the panel.

The coupling may be formed in two parts which are snap fitted together from opposite sides of the panel.

A strap may be attached to a collar which swivels about a coupling on the harness. A strap may be stitched to the coupling or collar or it may be adjustably held by a friction locking arm on the coupling.

Other aspects preferred features and advantages of the invention will be apparent from the following description and the accompanying claims.

The invention will be further described by way of example only with reference to the accompanying drawings, in which.

Figure 1:
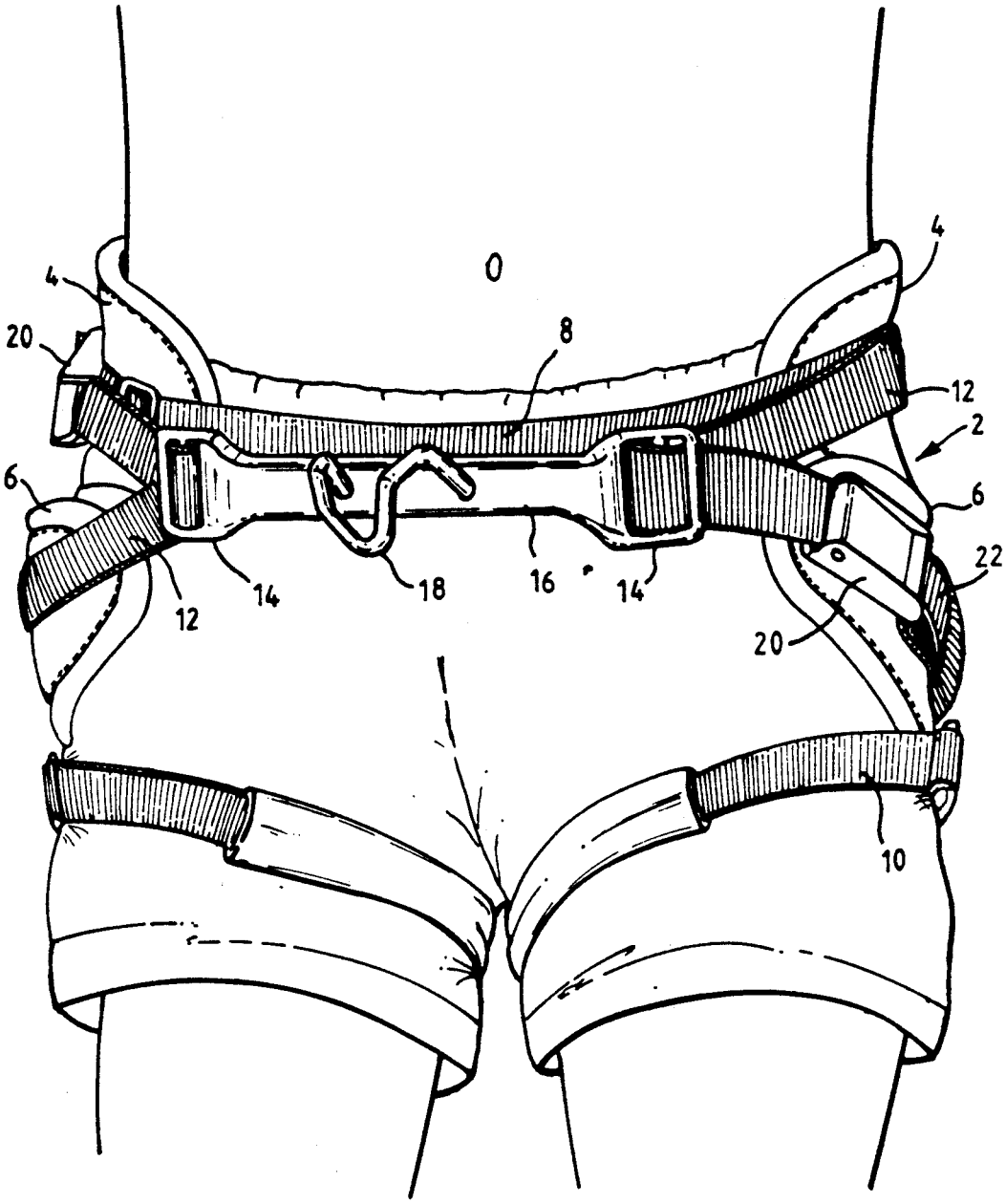
FIG. 1 is a view of a prior art harness, which fits around the seat and hips of the wearer, shown being worn.

FIG. 1 shows a prior art type of harness 2 which fits around the seat and hips of a wearer. The harness 2 comprises two panels 4, 6 which extend around the back of the wearer. An adjustable waist strap 8 and two adjustable thigh straps 10 hold the harness 2 firmly on the wearer. Two boom hook straps 12 on opposite sides of the wearer loop through respective ends 14 of a bar 16 which carries a hook 18 for hooking over the boom of a sailboard, enabling the wearer to transfer his weight to the boom via the harness.

The strap ends and various buckles are attached to the harness by stitching. For example, the lever type strap locks 20 which secure the free end of straps 12 are held on the harness parts 4, 6 by webbing loops 22 which are sewn to the harness parts. Thus as the hook bar 16 moves vertically up and down there is a tendency to twist the straps 12 and the loops 22 relative to their mounting points, which places a strain on the stitching and also inhibits the even transfer of load between the hook 18 and the harness.

Figure 2:
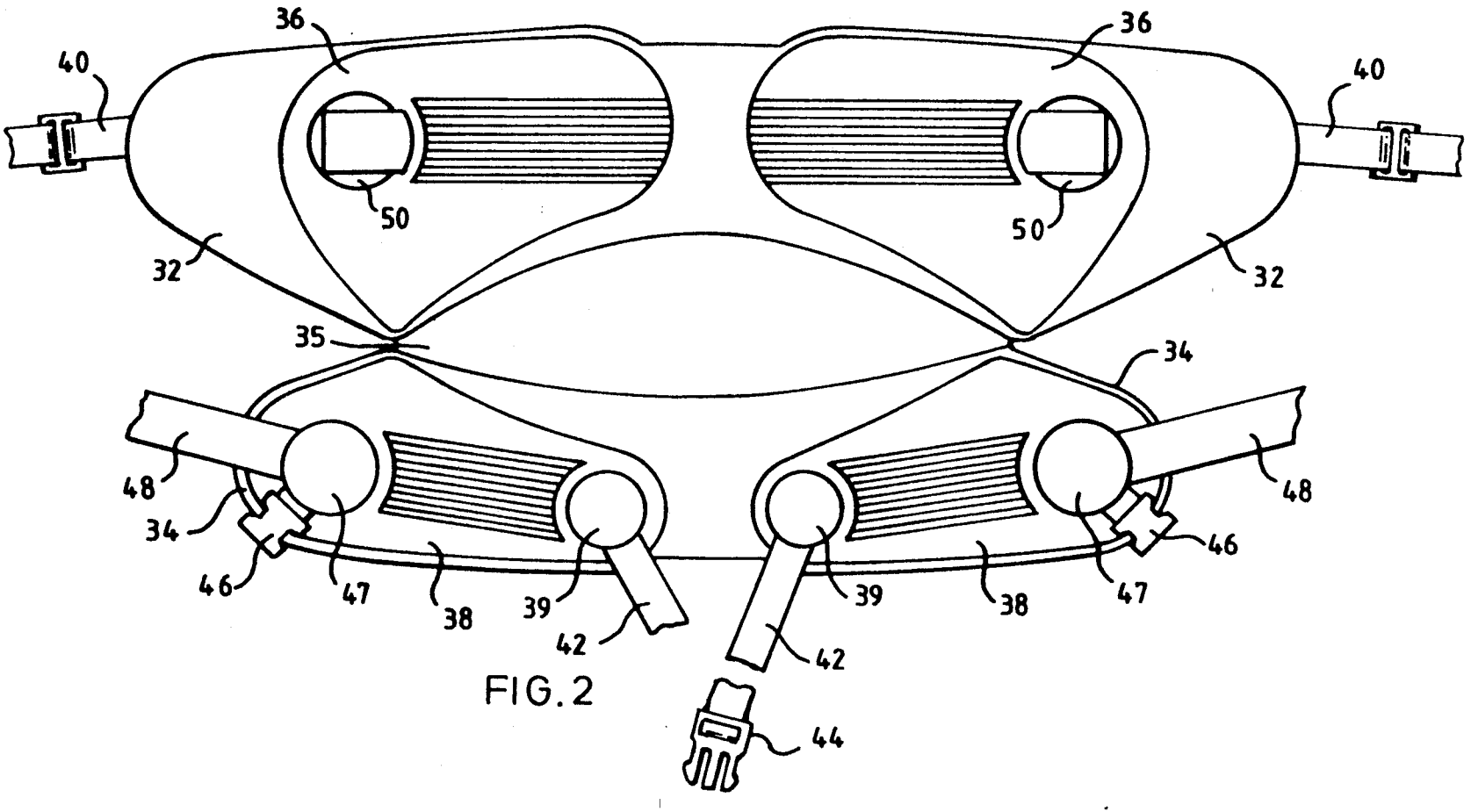
FIG. 2 is a plan view of a harness in accordance with the invention which is of a type similar to that of FIG. 1.

FIG. 2 shows in plan view a harness 30 which is similar in function to the harness 2, but in accordance with the invention includes one or more novel couplings attaching the straps on the harness. The body part of the harness comprises two panels 32, 34 of soft foam material a few millimetres thick joined by a nylon web 35. The foam may have a covering of nylon or similar material on it. Panels 36, 38 of polyethylene high modulus plastics sheet (PE-HM) one to two millimetres thick are glued or sewn to the foam panels 32, 34. The PE-HM sheet material is substantially rigid, that is it has some flexibility but will not stretch or buckle.

The harness 30 fits around the seat of the wearer, the foam 32, 34 facing the body, and has a waist strap 40 which includes an adjustable buckle (not shown) and two thigh straps 42. The thigh straps 42 are attached to the inner ends of respective panels 38 by couplings 39. The straps 42 pass around the front of the thigh and each end in an adjustable male clip 44 which clips in a respective female clip 46 attached to the outer ends of the respective panel 38 by couplings 47. Two boom hook straps 48 are attached adjacent to the outer ends of the panels 38 by the couplings 47 and, after looping through the ends of the hook bar 16 (FIG. 1) are attached to respective couplings 50. The free ends of the straps 48 are plain and are held on the couplings 50 by fiction lever type locks as will be described more fully hereinafter.

Figure 3:
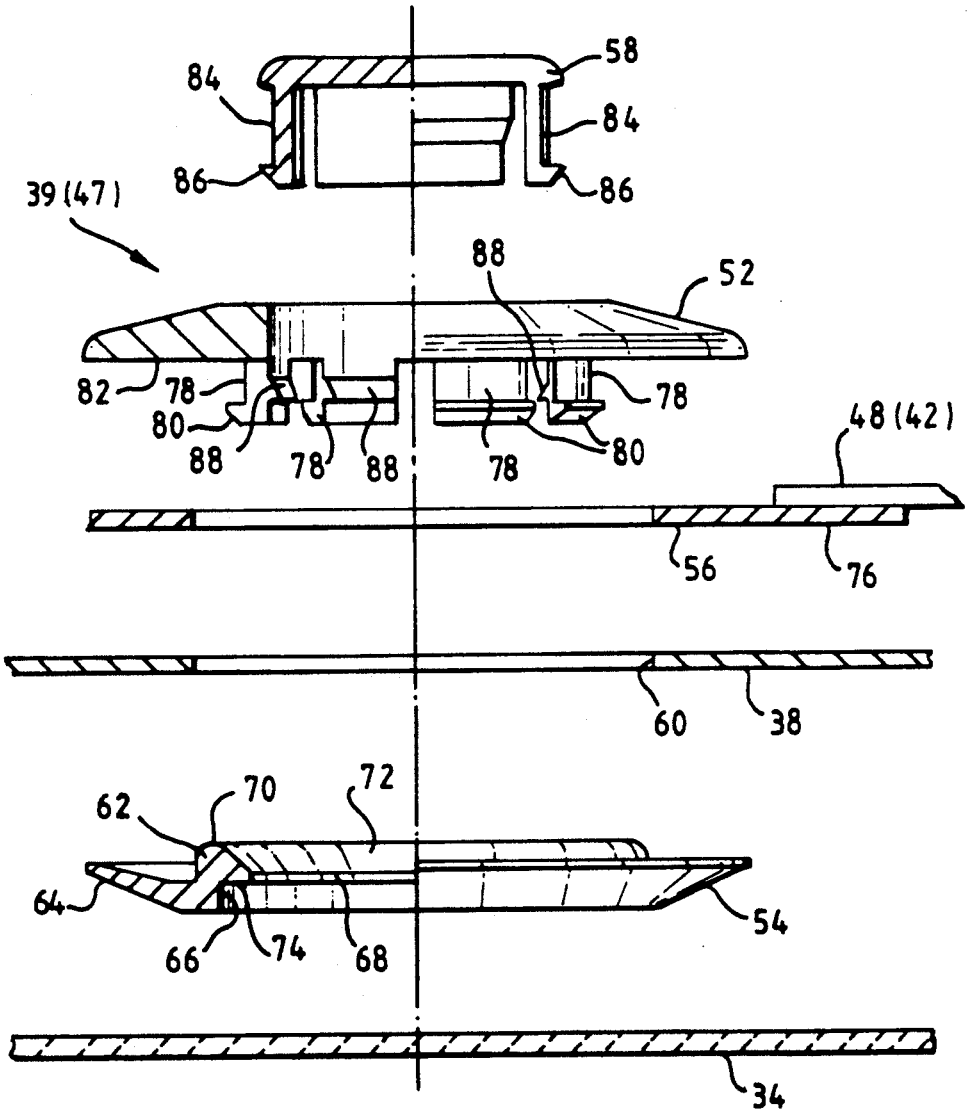
FIG. 3 is an exploded view of a first type of coupling used in the harness of FIG. 2.

FIG. 3 shows in exploded view, partly in cross-section, a coupling of the type 39, 47 used on the panels 38. The coupling 39, 47 is in four parts; a snap rivet 52; a locating ring 54; a washer 56, and a locking member 58. The parts of the couplings 39, 47, 50 are moulded from plastics material, such as nylon.

The coupling 39, 47 is located in a circular aperture 60 in the plastics sheet 38. The locating ring 54 is annular and has a circular wall 62 which projects through the aperture 60 in sheet 38. A circular flange 64 projects upwardly (as seen in FIG. 3) from the lower end 66 of the wall 62 and an annular lip 68 extends radially inwardly from the upper end 70 of the wall 62. The upperside 72 of the lip 68 is sloped and the underside 74 forms a ledge perpendicular to the wall 62. The ring 54 is positioned between the plastics sheet 38 and foam 34. The washer 56 is positioned about the wall 62, above the aperture 60 and is generally annular with a tongue 76 extending to one side. A strap 48(42) is stitched to the tongue 76. The snap rivet 52 is annular and has a plurality (eight in the example) of resilient legs 78 which project through the washer 56 and aperture 60. Legs 78 each have a hooked end 80 which engages under the lip 68 to hold together the rivet 52 and locating ring 54. The washer 56 and plastic sheet 38 are sandwiched between the flange 64 and an annular flange 82 of the rivet 52.

As the rivet 52 and locating ring 54 are snapped together, the hooked ends 80 of legs 78 ride over the sloping surface 72 of lip 68 to engage the underside 74 of the lip 68. To prevent the rivet 52 and locating ring 54 being pulled apart, the locking ring 58 is provided. Locking ring 58 is arranged to fill the central aperture defined by the legs 78 and has two legs 84 having hooked ends 86 which engage lips 88 on the radially inner side of the legs 78. Once installed, the locking ring 58 prevents the legs 78 flexing inwards.

The locking ring 58 may be dispensed with, the legs 78 being made sufficiently rigid to prevent the locating ring 54 and rivet 52 being pulled apart in normal use. In this case, the flange 52 may be formed by a disc so that there is no through aperture in the rivet 52.

The outer diameter of the wall 62 is slightly less than the diameter of the aperture 60 to allow the coupling to pivot circumferentially in the aperture 60. Also the washer 56 is loose about the wall 62 to enable it to pivot as strap 48(42) is pulled in a circumferential direction.

To assemble the coupling, strap 48(42) is attached to the washer 56 and the parts 54, 56, 52 and 58 assembled together about the plastics panel 38. The foam sheet 34 is then glued to the panel 38. The load on strap 48(42) can thus be transferred to the coupling 39(47) and thence across the area of the panel 38. Two or more washers 56 may be used to attach different straps, as at coupling 47. Thus the strap is able to swivel about the coupling, washer 56 rotating about wall 62 and the coupling may rotate within the aperture 60 in panel 38. It will be appreciated that, in place of a washer 56, a strap may, for example, be attached directly to a coupling member 52.

Figure 4:
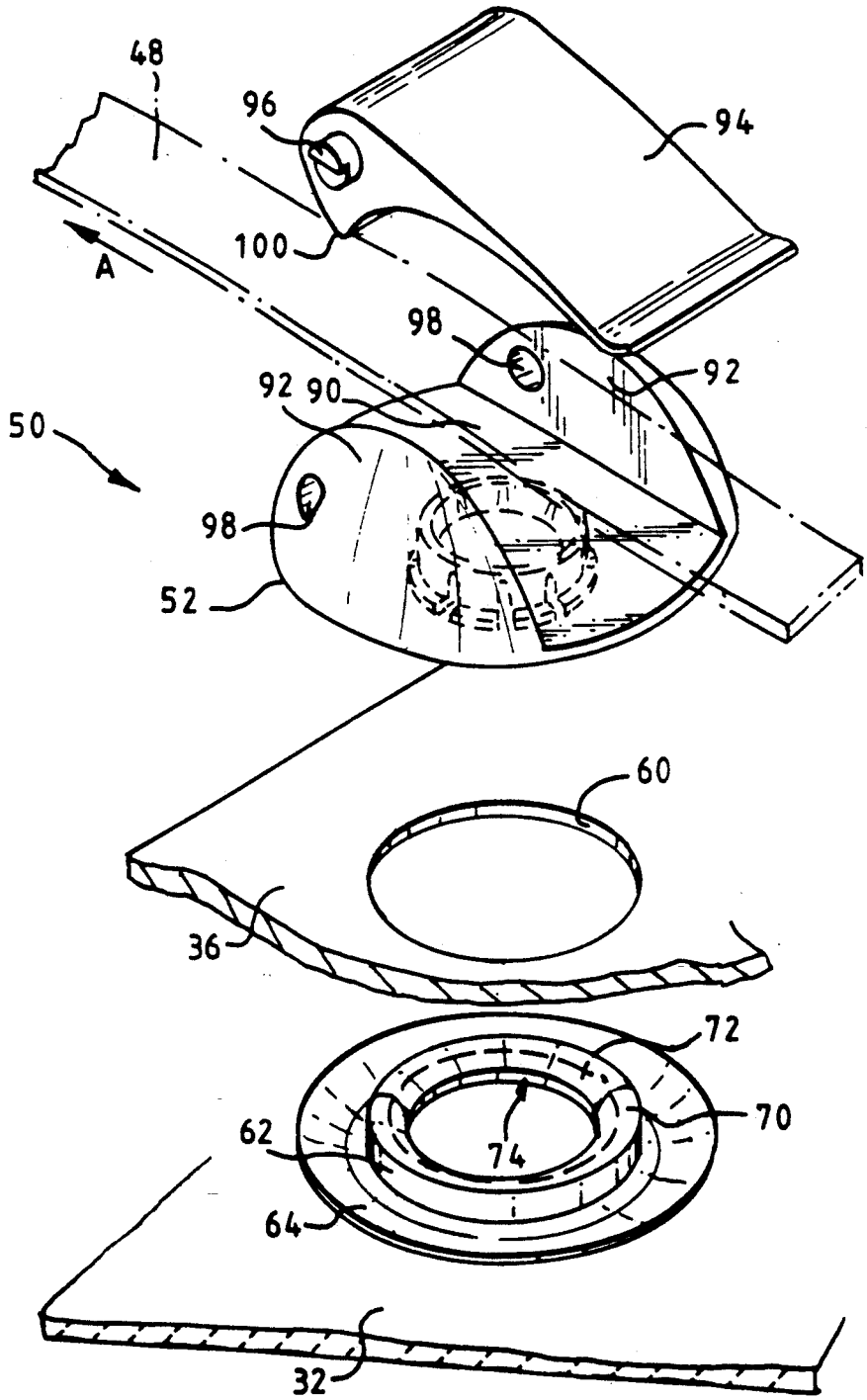
FIG. 4 is an exploded view of a second type of coupling used in the harness of FIG. 2.

FIG. 4 shows a coupling 50 for terminating a free end of the straps 48. This coupling operates in the same manner as couplings 39, 47 save that the rivet 52 includes a plate 90 having upright walls 92 which support a lever 94. Lever 94 is pivotably mounted between the walls 92 by stub axles 96 received in bores 98 in the walls 92. A toe 100 on the lever 94 traps the strap 48 against the plate 90 such that force on the strap 48 in the direction of arrow A serves to tighten the grip on the strap. The coupling 50 swivels in the aperture 60.

The coupling 50 may be modified to terminate a strap on the harness. In place of the lever 94, a rod may be fixed in the bores 98 to span between the walls 92 and the strap may have a loop formed at its end to encircle the rod.

Various other modifications may be made to the described embodiment. For example, the invention is equally applicable to waist and chest harnesses, the number and type of couplings being varied accordingly. Also, the body part of the harness may be in the form of a pair of stretch shorts or a vest, relatively stiff plastic panels being suitably positioned and used to distribute forces from the straps, via the couplings, over a significant area of the shorts or vest. It will be appreciated that not all the straps may need to be attached to a harness by the couplings, for example, some may be attached by sewing in the usual way. Also, a coupling may terminate a strap on the harness and also be adapted to secure a free end of a strap.

I claim:

1. A harness for boardsailing, the harness comprising two first panels of flexible material which fit laterally across the body of a boardsailor separated and connected together by a web, a pair of substantially rigid panels laterally separated and secured to each first panel, two boom straps extending respectively between the two first panels and swivably connected at each end to one of each pair of rigid panels.

2. A harness according to claim 1, including two leg straps, one end of each leg strap being swivably connected to one of the rigid panels by the same connector as a respective boom strap.

* * * * *